United States Patent [19]

Classon

[11] Patent Number: 4,736,470

[45] Date of Patent: Apr. 12, 1988

[54] LIFTING ASSEMBLY FOR LID AND SEAT STRUCTURES OF A TOILET

[76] Inventor: Nils Classon, 3520 SW. 79 St., #C325, Miami, Fla. 33147

[21] Appl. No.: 895,733

[22] Filed: Aug. 12, 1986

[51] Int. Cl.[4] ..... E03D 9/00; A47K 13/10

[52] U.S. Cl. ..... 4/222; 4/251

[58] Field of Search ..... 4/251, 209, 222

[56] References Cited

U.S. PATENT DOCUMENTS

| | | | |
|---|---|---|---|
| 1,084,426 | 1/1914 | Haley | 4/251 X |
| 1,654,520 | 12/1927 | Frohlich | 4/251 |
| 1,792,811 | 2/1931 | Bustin | 4/251 |
| 2,136,684 | 11/1938 | Greava | 4/251 |
| 2,473,082 | 6/1949 | Warner | 4/251 |
| 3,055,016 | 9/1962 | Kemp | 4/251 |
| 3,088,125 | 5/1963 | Southwood | 4/222 |
| 3,371,355 | 3/1968 | Wipf | 4/222 |
| 3,516,095 | 6/1970 | Clifton et al. | 4/251 |
| 4,434,938 | 3/1984 | Rosenkrantz et al. | 4/222 X |
| 4,670,916 | 6/1987 | Bloom | 4/222 X |

*Primary Examiner*—Charles E. Phillips

*Attorney, Agent, or Firm*—Charles J. Prescott

[57] ABSTRACT

A lifting assembly for the lifting of both a lid and seat structure of conventional design normally placed in covering relation to the open mouth of a toilet bowl wherein utilization of the toilet assembly necessitates the lifting or positioning of at least the lid and preferably the seat portion in a non-covering relation to the open mouth of the toilet bowl. Two lifting assemblies are independently structured and mounted on the support frame for the independent and successive lifting of the lid and/or the seat structures and are each activated or operated by application of foot pressure thereby eliminating need to touch either of the lid or seat structure with the hand of the user.

10 Claims, 2 Drawing Sheets

LIFTING ASSEMBLY FOR LID AND SEAT STRUCTURES OF A TOILET

BACKGROUND OF THE INVENTION

1. Field of the Invention

A foot operated lifting apparatus of the type including a first and second lifting assembly each independently structured and positioned to lift and maintain either the lid or seat structure in an upright position so as to uncover the mouth of the toilet bowl for use thereof in a standing or upright position when it is not desired to sit on the seat.

2. Description of the Prior Art

In conventional, modern-day toilet assemblies, it is common to have a seat portion including a central aperture and a substantially annular shaped support dimensioned and configured to allow a user to be supported in overlying relation to the mouth of the toilet bowl. The referred to lid structure is dimensioned and positioned to be pivotally attached so as to cover the central aperture of the seat and thereby close off the open mouth of the toilet bowl.

While the lid and seat structure are in common usage, it is also well recognized that in certain instances it may be distasteful or even unsanitary to position the seat structure between the open, upright position and the closed, covering position.

In order to overcome the above set forth problem of positioning the seat and lid structure by hand, the prior art is replete with numerous "lifting assemblies" capable of positioning the lid or seat structure between an open and covering position relative the the mouth of the toilet bowl without use of the hands. However, devices of the type referred to, in some instances, may be considered overly complicated and/or somewhat limited in their operation at least partially based on the fact that such structures lift both lid and seat structures at one time thereby lacking the versatility of selective positioning of either the lid or seat structure.

Accordingly, there is a need for a device which is structured to be versatile in its operation to the extent of being capable of being selectively positioning either the seat or lid structure between the aforementioned open or covering position independently of one another through operation of a foot activated mechanism wherein the lifting assembly for positioning the lid is independent and distinct from the lifting assembly for positioning the seat structure.

In addition, such a preferred lifting device should be capable of performing additional ancillary functions such as flushing the toilet assembly, after use, in conjunction with selective positioning of at least one of the lid or seat structures. Also, the automatic dispensing of air freshner or deoderant can also be associated with the lifting device of the present invention to be described in greater detail hereinafter.

SUMMARY OF THE INVENTION

The present invention is directed to a lifting apparatus specifically designed to be used in combination with a conventional toilet assembly and more specifically to be mounted on a toilet bowl. In operation, the lifting apparatus of the present invention is structured to lift, independently of one another, the lid and seat structures for exposure of the mouth of the toilet bowl and the interior thereof when it is not desired to sit on the seat structure over the mouth of the toilet bowl. The subject lifting apparatus enables the independent and selective lifting of the aforementioned lid and seat structure without use of the hands.

More specifically, the subject lifting apparatus comprises a support frame including a mounting member dimensioned and configured to extend across the upper or exposed face of the toilet bowl which surrounds the open mouth thereof. The mounting member therefore allows the subject lifting apparatus to be readily adaptable to any modern-day, conventional sit-down toilet seat assembly in that it connects directly to the connecting bolts or like connecting members which pivotally secure the seat and lid structure to the uper exposed face of the toilet bowl. The mounting member is part of the support frame which extends downwardly on opposite sides of the bowl to the floor or like supporting surface on which the toilet assembly is positioned.

Two independently disposed and structured lifting assemblies are provided each positioned for the separate and selective lifting of a separate one of the lid structures and/or seat structures through force being applied thereto by the foot of the user.

More specifically, each of the lifting assemblies includes an activating portion connected by appropriate linkage to a lift portion wherein the activating portion includes an outwardly extending and readily accessible foot pedal structure for depression thereof by the foot of the user without undue difficulty. The activating portion is positioned beneath and in engageable relation with an under-surface of the specific structure (lid or seat) which it is intended to lift. The interconnecting linkage serves to activate or move the lift portion to its lifting position thereby forcing the respective lid or seat structure off of its covering relation to the mouth of the toilet bowl.

Ancillary structures associated with the subject lifting apparatus includes a dispensing apparatus including a dispensing pump activated by a trigger element. The trigger element is positioned in interruptive relation to the position of the lid structure (or seat structure) to the extent that the trigger element is "tripped" thereby activating the pump for a single stroke and dispensing a predetermined or selected amount of air freshner or deodorant from a container or supply. Other features of the present invention include an automatic flushing assembly which, upon selective movement of a preferred one of the seat or lid structures into and out of its upright or open position, the flushing structure will move relative to the conventionally constructed and designed flushing handle causing the waste material, if any, placed in the toilet bowl to be removed. Yet another feature of the present invention is the ability to lock one or both of the aforementioned lifting assemblies in the open or uncovered position so that either one or both of the lid or seat structures does not inadvertently fall into its covering position.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts thoughout the several views of the drawings.

DETAILED DESCRIPTION OF THE PREFERRED EMBODIMENT

Figures 1, 1A, 1B:
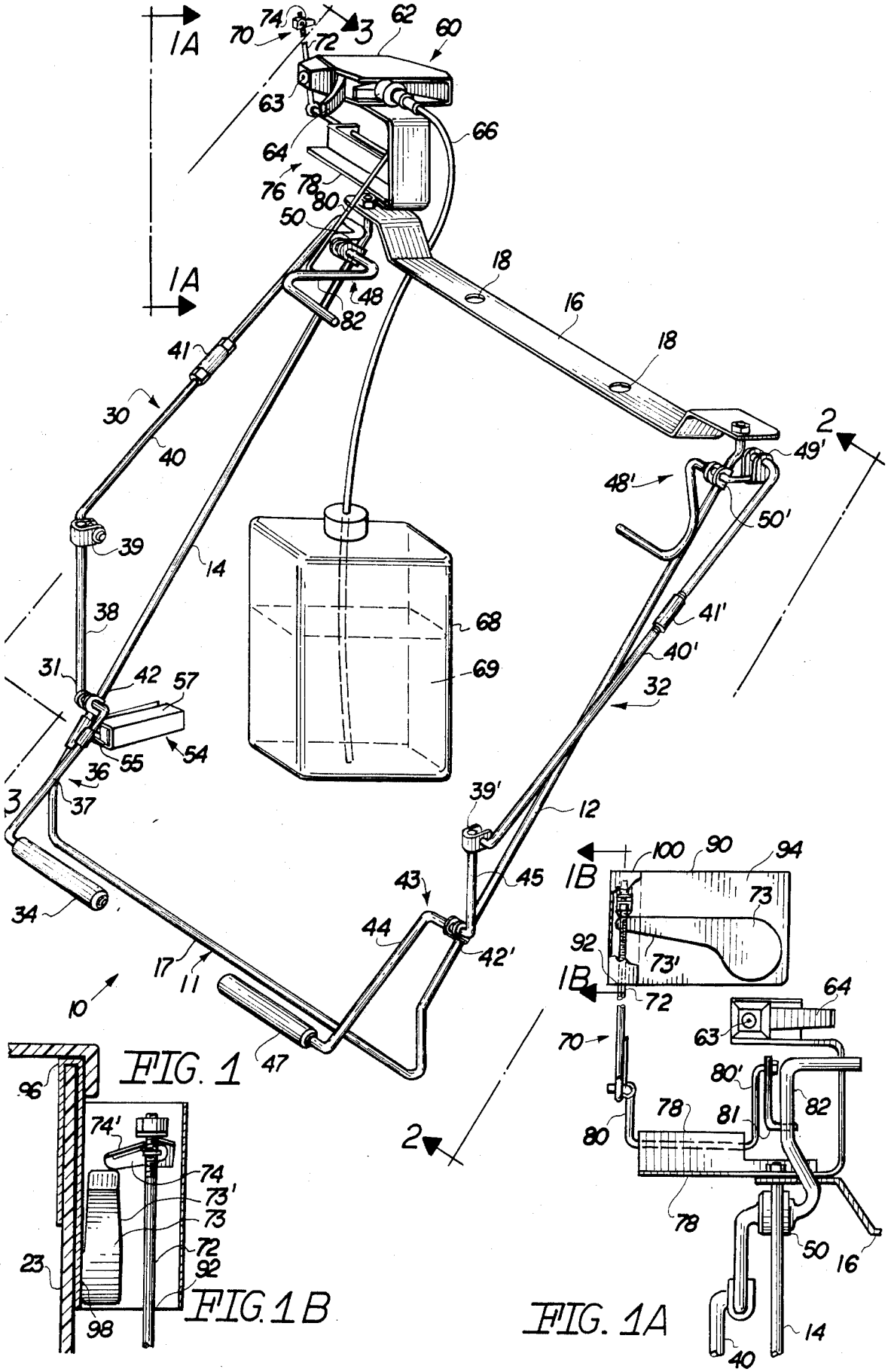
FIG. 1 is a perspective view of the lifting apparatus of the present invention wherein a flushing assembly associated therewith is shown in partial cutaway.
FIG. 1A is a detailed forward view in partial cutaway of the flushing assembly associated with the lifting apparatus of the present invention.
FIG. 1B is a detailed side view in partial cutaway of the flushing and housing assembly associated with the lifting apparatus of the present invention.
Figure 2:
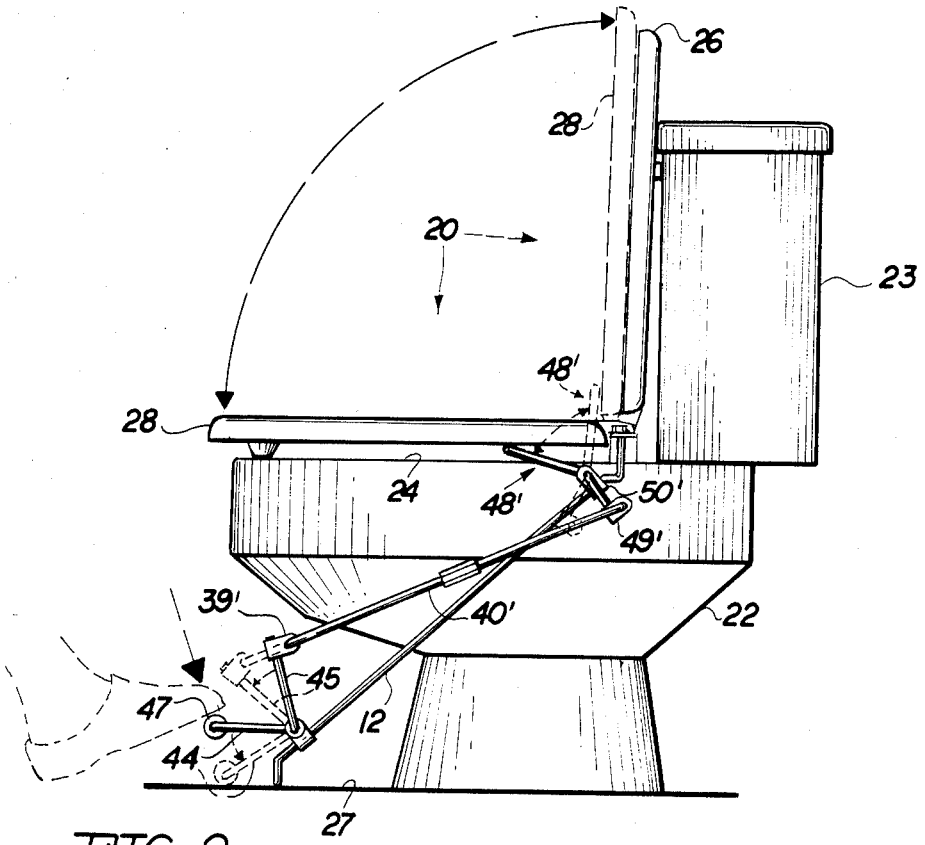
FIG. 2 is a side plan view of the assembly of FIG. 1 showing one of two lifting assemblies in operation and being partially represented in phantom lines.
Figure 3:
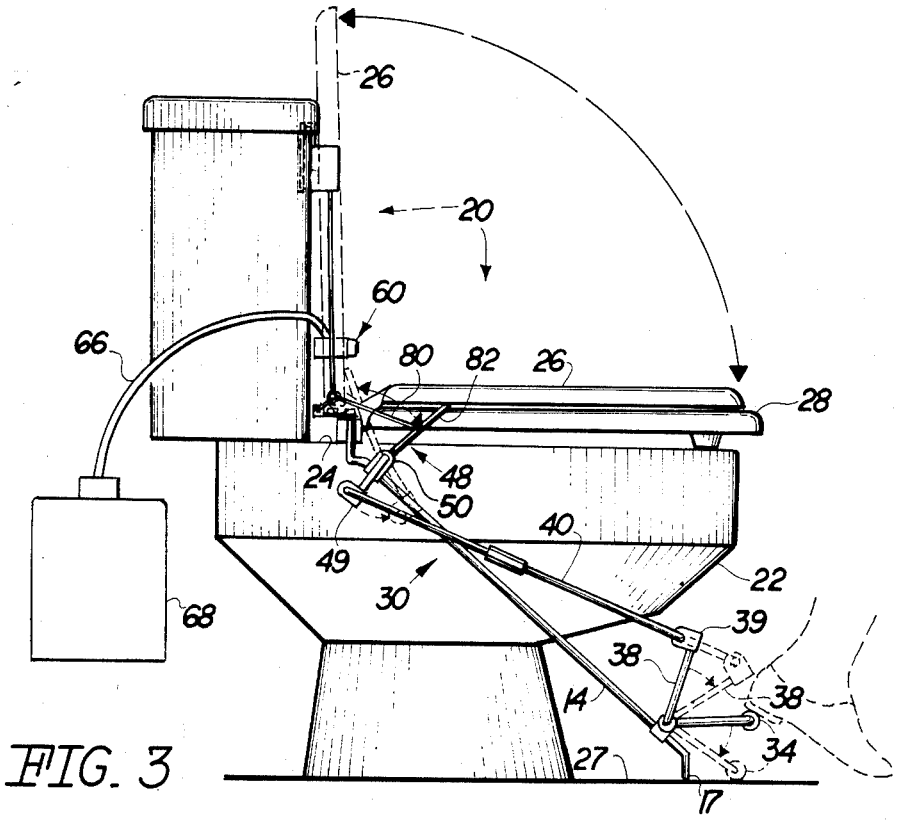
FIG. 3 is an opposite side plan view to that of FIG. 2 showing the other of the two lifting assemblies in its operative position and being partially represented in phantom lines.

As shown in FIGS. 1 and 3, the present invention is directed towards a lifting apparatus generally indicated as 10 comprising a support frame 11 including two longitudinal sides or legs 12 and 14 connected at one end to a mounting member 16. The mounting member 16 has at least two apertures 18 dimensioned and relatively disposed to accommodate connecting members such as the bolts normally associated with a lid and seat assembly generally indicated as 20 in FIGS. 2 and 3. The connecting bolts, while not clearly shown, are common to most modern-day sit-down toilet assemblies and are generally used to secure the lid and seat assembly to the toilet bowl 22 and more particularly, to an exposed upper face thereof 24 surrounding the open mouth of the bowl. Accordingly, while the mounting member 16 serves to fixedly and securely attach the support frame 11 in the position shown in FIGS. 2 and 3 to the toilet bowl 22, the lid structure 26 and seat structure 28 each may be pivotally secured in substantially overlying relation to the mouth of the toilet bowl (not shown for purposes of clarity) in the conventional fashion. Such pivotal movement into and out of overlying relation and between the covering relation shown in solid lines in FIG. 3 and the upright or open position shown in phantom lines in FIGS. 2 and 3 is thereby possible.

With reference to FIG. 1, the support frame includes a supporting brace or like member 17 which, as shown, may be of one piece construction extending between and integrally formed with the longitudinal sides 12 and 14. The support brace 17 may rest directly on a supporting surface such as a flooring 27 such that the support frame 11 is adequately braced and supported through connection of the mounting member 16 with the connecting bolts associated with the seat assembly 20 and the firm, supporting engagement of the support brace 17 with the flooring 27.

Again primarily with reference to FIG. 1, the lifting apparatus of the present invention includes a first lifting assembly 30 and a second lifting assembly 32 both having somewhat similar construction and components but differing in that they are independently operable to lift and position separate ones of the lid structure 26 and seat structure 28. The first lifting assembly 30 includes an activating portion 31 including an activating arm generally indicated as 36 and including a first portion 37 and a second portion 38. A foot pedal 34 extends outwardly from the support frame 10 and substantially defines the free end or extremity of the first portion 37 of the activating arm 36. The second portion 38 is angularly oriented out of colinear relation with the first portion 37 and is pivotally connected as at 39 with a connecting link or linkage 40. In addition, the first activating arm 36 is pivotally connected to one side or arm 14 of the frame 10 as at 42.

With regard to the second lifting assembly 32, the structure of the second activating portion 43 is substantially the same as the first activating portion 31, the second activating arm generally indicated as 43 including a first portion 44 and a second portion 45 being angularly oriented relative to one another and a foot pedal 47 defining the free end of the first portion 44 extending outwardly from the support frame 10 so as to be readily accessible. Pivotal connections 42' and 39' are also similarly placed on the second activating assembly or activating arm 43 as the first activating arm 36. However, the structures may differ in relative dimension such as in the second portions 38 and 45 respectively of the first and second activating portions.

A connecting link or linkage 40' also serves to interconnect the second activating portion 43 to the second lift portion generally indicated as 48'. Similarly, the first lift portion 48 is pivotally connected as at 49 (shown in FIG. 3) to the correspondingly positioned end of the connecting link 40. Similar structures exist relative to the pivotal connection 49' serving as the pivotal interconnection between the second lift portion 48' and the connecting link 40'. Both lift portions 48 and 48' are also pivotally connected as at 50 and 50' to their respective longitudinal sides 14 and 12 of the support frame 10. It can also be seen that the upper extremities of the sides 12 and 14 are fixedly connected, possibly by a conventional connector element to the mounting member 16 at the corresponding ends thereof as clearly shown in FIG. 1. Further adjustable sleeve members 41 and 41' serve on the connecting links 40 and 40', respectively, to lengthen or shorten said links depending on the preference of the user and the height or length of toilet bowl design.

With references to FIGS. 2 and 3, the various positions of the first lifting assembly 30 (FIG. 3) are indicated relative to the resulting positions of the lid structure 26 and seat structure 28 respectively upon depression of the respective foot pedals 34 and 47 (FIGS. 3 and 2) by the foot of the user as best shown in FIG. 2.

Other structural features associated with the present invention is the provision of a lock assembly as shown in FIG. 1 and generally indicated as 54. The lock 54 is of the attach-release type commonly used in cabinets, wherein depression or downward forcing of the pedal 34 causes a finger 55 to pass into the interior of the casing 57 and into retaining engagement with a latch of conventional design (not shown for purposes of clarity). A second depression of the pedal 34 will then cause interaction between the finger 55 and the interior latch within casing 57 causing its release. When in its latched position, the first lift assembly 30 cannot be released unless the foot pedal 34 is again depressed thereby maintaining the lid 26 in its open or uncovered position as shown in phantom lines in FIG. 3. This of course prevents inadvertent falling or dropping of the lid structure 26 into its closed position. It should be further noted that while one locking assembly 54 is shown only with regard to association with the first lift assembly 30, a second or additional locking assembly could be also associated with the second lifting assembly 32. As best shown in FIG. 1, a dispensing assembly is generally indicated as 60 and includes a pump member 62 of substantially conventional design having a dispensing aperture 63 and an activating trigger element 64. A flexible material hollow conduit 66 serves to inter-connect the pump 62 with a supply container 68 containing air freshner or deodorant 69. It is important to note that the trigger element 64, when depressed, serves to activate the pump 62 causing a single stroke of the pump 62 thereby causing a predetermined amount of air freshner 69 to be dispensed to the atmosphere surrounding the toilet and eliminating or reducing any unpleasant odors. The positioning of the finger element 64 is such as to be in interruptive engagement with the lid structure 26 when in its upright or open position as generally shown in FIG. 3. Accordingly and on each occasion when the foot pedal 34 is depressed, interruptive engagement occurs between the lid 26 and the activating finger or trigger element 64, and the pump is activated in terms of performing a single stroke. Upon removal or positioning of the lid structure 26 in its closed position as shown in solid lines in FIG. 3, the trigger element 64, may be spring biased to extend outwardly ready for its next engagement and performance of an activating stroke again with the lid structure 26 is forced there-against.

As shown in FIGS. 1, 1A and 1B, the structure of the present invention further includes a flushing assembly generally indicated as 70 which is specifically designed and disposed to automatically manipulate a conventional flush handle 73 so as to flush the conventional toilet assembly each time the lid is moved from its raised position through the activation of the first lifting assembly 30. More specifically, an elongated rod 72 has a pivotally mounted finger 74 secured to the upper extremity thereof as clearly shown in FIG. 1A and 1B. The interconnection between rod 72 and finger 74 is such as to allow pivotal movement of finger 74 only when the upper surface 74' engages the under-portion 73' of the handle 73. To the contrary, when the finger 74, during the downstroke or downward travel of rod 72, engages the handle 73 in the manner shown in FIG. 1A, it will not pivot or travel in a counterclockwise position but instead force the handle 73 downwardly to its flushing position. The upward and downward movement of the rod 72 and the resulting movement of the finger 74 occurs through interconnection of an activating link 80 to a support base 78 as shown in FIG. 1A. One end of the link 80 is pivotally secured to the bottom of rod 72 wherein the other end as at 80' is pivotally secured to a connecting link 81. The opposite end of the connecting link 81 is pivotally secured to the lift member 82 which serves to raised the lid 26 into the open position as represented in phantom lines in FIG. 3.

A housing assembly 90, as shown in FIGS. 1A and 1B, serves to maintain the vertical position of the finger 74 in cooperative engagement with said handle 73 by providing a housing portion 100 fitted with a slot 92 through which the rod 72 is permitted to freely slide upward and downward. Said housing assembly 90 is attached to the water vessel generally referenced as 23 and conventionally mounted on the rearward portion of the toilet bowl 22. More particularly, the housing assembly comprises a flat portion 94 having an upper lip portion 96, said flat portion fitting between the handle 73 and the vessel 23 and having a hole as at 98 to accomodate the conventional bolt means (not shown) attaching the handle 73 to the vessel 23.

Accordingly, every time the lid 26 is moved to the open position as shown in phantom lines in FIG. 3, two functions automatically occur. one is the activation of the pump 60 such that an air freshner or deodorant is released tho the atmosphere surrounding the toilet. Second is the raising of the rod 72 to a position where the finger 74 is positioned above the flush handle 73 into the potentially activating position as shown in FIGS. 1A and 1B. Movement of the lid 26 down into the closed position represented in solid lines in FIG. 3 causes the lift arm 82 into the position shown in FIG. 3 in solid lines thereby causing a downward movement or travel of the rod 72 and a forcing of the finger 74 against the flush handle 73 to its flush position.

It is therefore to be understood that the following claims are intended to cover all of the generic and specific features of the present invention herein described, and all statements of the scope of the invention which as a matter of language, might be said to fall there between.

Now that the invention has been described,

What is claimed is:

1. A lifting assembly designed to independently position a lid and a seat which are designed to cover an open bowl of a sit down toilet including standard bolts attaching said lid and seat and further including a front, a rear, a left side, and a right side, said assembly comprising:

(a) a support frame structured for manual placement about a toilet, and, including a first end and a second end;

said first end including connecting means for securing said support frame to the toilet with the standard bolts attaching the lid and seat and providing said assembly with a first stabilizing location;

said support frame extending outwardly and relatively symmetrically about the toilet from said first end to said second end;

said second end structured for abutting relation with a supporting surface on which the toilet rests and including a portion extending horizontally in abutting relation with said support surface, said portion of said second end designed for providing said assembly with a second stabilizing location;

(b) a first lifting assembly movably connected to said support frame and extending substantially along one side of the toilet, said first lifting assembly comprising a first activating portion drivingly interconnected to a first lift portion;

said first activating portion extending outwardly from said support frame in an accessible position to a foot of a user;

said first lift portion disposed in engageable relation to the lid structure on the toilet;

(c) a second lifting assembly movably connected to said support frame in spaced relation to said first lifting assembly and extending substantially along the opposite side of the toilet from said first lifting assembly, said second lifting assembly comprising a second activating portion drivingly interconnected to a second lift portion;

said second activating portion extending outwardly form said support frame in an accessible position to a foot of a user and spaced from said first activating portion, said second activating portion being designed for a user to depress said second activating portion while using the toilet and to release said second activating portion upon concluding use of the toilet;

said second lift portion disposed in engaging relation to the seat structure on the toilet and designed for lifting both the lid, if any, and seat of the toilet;

said first and said second lifting assemblies disposed on said support frame in substantially spaced relation to one another and being independently operable to independently and alternatively lift the lid structure or the seat and lid structures, respectively;

said assembly further comprising a pump means for returning the lid or seat and lid to their horizontal position and for directing spray to the area surrounding the toilet, said pump means comprising a trigger element disposed in interruptive engagement with the lid structure when the lid structure is in an upright position;

said trigger element being placed under compression when the lid structure is in an upright position and acting to close the lid structure upon release of said first or second activating portions, and;

said pump means interconnected in fluid communication with a deodorant supply and structured to release deodorant to atmosphere, by pumping action, upon successive engagement and disengagement of the lid structure with said trigger element.

2. An assembly as in claim 1 wherein at least one of said activating portions is mounted on said system frame in removably retaining attachment with a hold means, said hold means structured for releasable engagement and mounting of said lift portion when in a lid-up position, whereby the lid structure is prevented from inadvertently falling into a lid closed position.

3. An assembly as in claim 1 wherein each of said first and second lifting assemblies further comprise an actuating arm pivotally connected to said support frame and including a first portion and a second portion disposed in angular orientation to one another and extending outwardly from the pivotal connection to said foot pedal and in interconnection with said corresponding lift portion respectively.

4. An assembly as in claim 1 wherein said first and second lifting assemblies each comprises a connecting link having a substantially elongated configuration and being pivotally connected at its opposite longitudinal ends to a correspondingly disposed activating portion and lift portion.

5. An assembly as in claim 4 wherein at least one of said connecting links include an adjusting means secured thereto for varying the length of said one connecting link.

6. An assembly as in claim 1 wherein said support frame comprises two elongated arms each connected to said first end, each of said legs extending downwardly from said first end to said second end on opposite sides of the bowl into resting engagement on the supporting surface on which the toilet rests.

7. An assembly as in claim 6 wherein each of said first and second lifting assemblies are substantially supported on and movable connected to a separate one of said arms and extend substantially along the length thereof.

8. An assembly as in claim 7 wherein each of said activating portions comprises a foot pedal disposed substantially adjacent a lowermost end of said correspondingly positioned arm and adjacent the supporting surface.

9. An assembly as in claim 1 wherein each of said lift portions include one end positioned in engageable relation with the lid structure and seat structure respectively; an opposite end of each lift portion pivotally interconnected to a corresponding one of said actuating portions.

10. An assembly as in claim 9 wherein each of said lift portions is pivotally mounted on said support frame at a location intermediate said one end and opposite end of each lift portion.

* * * * *